US005729789A

United States Patent [19]

Tamaki

[11] Patent Number: 5,729,789

[45] Date of Patent: Mar. 17, 1998

[54] THERMAL FIXING DEVICE FOR AN IMAGE FORMING APPARATUS

[75] Inventor: Syunpei Tamaki, Hadano, Japan

[73] Assignee: Ricoh Company, Ltd., Tokyo, Japan

[21] Appl. No.: 581,995

[22] Filed: Jan. 2, 1996

[30] Foreign Application Priority Data

Mar. 3, 1995 [JP] Japan ..... 7-068908

[51] Int. Cl.[6] ..... G03G 15/20

[52] U.S. Cl. ..... 399/70; 219/216

[58] Field of Search ..... 355/208, 282, 355/285, 30; 219/216, 494, 490; 432/60; 430/124; 399/43, 44, 68, 69, 70, 33

[56] References Cited

U.S. PATENT DOCUMENTS

| | | | |
|---|---|---|---|
| 4,609,278 | 9/1986 | Taniguchi | 355/285 |
| 4,822,977 | 4/1989 | Leising et al. | 219/216 |
| 5,097,288 | 3/1992 | Akao et al. | 355/30 X |
| 5,138,379 | 8/1992 | Kanazashi | 355/208 |
| 5,216,225 | 6/1993 | Muto et al. | 219/216 |
| 5,280,328 | 1/1994 | Goto et al. | 355/285 |
| 5,287,154 | 2/1994 | Nakai et al. | 355/285 |
| 5,319,428 | 6/1994 | Maruko et al. | 355/285 X |
| 5,481,346 | 1/1996 | Ohzeki et al. | 355/285 |
| 5,504,567 | 4/1996 | Satoh et al. | 355/285 |
| 5,517,284 | 5/1996 | Ohtaka et al. | 355/208 |
| 5,581,341 | 12/1996 | Tanaka | 355/285 |
| 5,600,406 | 2/1997 | Aikawa et al. | 399/70 |

*Primary Examiner*—Arthur T. Grimley
*Assistant Examiner*—Sophia S. Chen
*Attorney, Agent, or Firm*—Oblon, Spivak, McClelland, Maier & Neustadt, P.C.

[57] ABSTRACT

In a thermal fixing device for an image forming apparatus, when a heat roller starts to be heated, a warm-up time matching the instantaneous roller temperature can be set and controlled with accuracy. The interval between the start of a paper after the start of a recording operation and the arrival of the paper at the fixing device is available for the elevation of the roller temperature to a fixable temperature. A period of time necessary for the roller temperature to reach a temperature at which the recording operation can be started is corrected on the basis of the instantaneous ambient temperature. The device therefore reduces the waiting time up to the time when the surface of the heat roller reaches a fixable temperature, and can control the surface of the heat roller to a stable fixable temperature.

3 Claims, 6 Drawing Sheets

COUNTER TIMER
21
MEMORY
22
COUNTER TIMER
30
AMBIENT TEMP SENSOR
29
23
23
23
PROCESS CONTROLLER
20
A D C
24
25
COMPARATOR
26
HEATER CONTROLLER
27
MAIN MOTOR DRIVER
28
PICK-UP MOTOR DRIVER
THERMISTOR
3
4
HALOGEN LAMP HEATER
12
MAIN MOTOR
7A
PICK-UP MOTOR

THERMAL FIXING DEVICE FOR AN IMAGE FORMING APPARATUS

BACKGROUND OF THE INVENTION

The present invention relates to a copier, digital multifunction machine, laser printer, facsimile apparatus or similar image forming apparatus and, more particularly, to a thermal fixing device for an image forming apparatus.

A conventional thermal fixing device for the above application has a heat roller accommodating a heater therein, a press roller pressed against the heat roller, and a thermistor contacting the outer periphery of the heat roller for sensing the surface temperature of the roller. A paper carrying a toner image thereon and coming out of an image transfer device is brought into a nip between the heat roller and the press roller. As a result, the toner image is melded by heat and fixed on the paper. The prerequisite is that the heat roller be heated to a fixing temperature at a sufficiently early stage for fixation. However, constantly heating the heat roller By applying a voltage to the heater wastes energy.

To save energy, it has Been customary to reduce or stop the supply of power to the heater in a stand-by mode, as distinguished from a record mode. This, however, increases the interval between the time when the stand-by mode is replaced with the record mode and the time when a recording operation can be actually started, i.e., the waiting time. This problem will be solved if the wall thickness of the heat roller 1 and, therefore, the heat capacity is reduced in order to enhance the temperature elevation efficiency. However, the decrease in the wall thickness of the heat roller 1 brings about other problems. Specifically, the surface temperature of the heat roller and the temperature sensed by the thermistor are different from each other. Despite that the surface temperature reaches a fixing temperature, the sensed temperature is still lower than the fixing temperature. As a result, when the sensed temperature reaches the fixing temperature, the actual surface temperature has been elevated to a temperature higher than the fixing temperature. Therefore, excess heat and excess time are wasted. Moreover, assume that the power supply to the heat roller is stopped due to the elevation of the sensed temperature to the fixing temperature. Then, the actual surface temperature sharply falls and continuously falls below the fixing temperature earlier than the sensed temperature. Hence, even if the power supply to the heat roller is resumed on the detection of the fall of the sensed temperature to below the fixing temperature, the surface temperature is lower than the fixing temperature. The toner image fixed in this condition is defective.

The above difference between the surface temperature of the heat roller and the temperature sensed by the thermistor is ascribable to thermal response delay caused by a relation between various factors including the thermal resistance between the thermistor and the heat roller, the thermal resistance to a structural body and acting via a thermistor support, and the thermal capacity of the individual section.

SUMMARY OF THE INVENTION

It is therefore an object of the present invention to provide a thermal fixing device for an image forming apparatus and capable of reducing a waiting time up to the time when the surface of a heat roller reaches a fixing temperature.

It is another object of the present invention to provide a thermal fixing device for an image forming apparatus and capable of controlling the surface of a heat roller to a stable fixable temperature.

In accordance with the present invention, in thermal fixing device for fixing a toner image on a paper by heating a heat roller while setting up a particular power supply condition to the heat roller for each of a stand-by mode and a record mode, a temperature sensor senses the temperature of the heat roller. A memory stores a table listing a relation between the temperature of the heat roller after the power supply condition has been switched to the record mode and the period of time necessary for the heat roller to reach a temperature at which a recording operation can be executed. A timer counts a period of time elapsed after the power supply condition has been switched to the record mode. A recording operation starting section causes a recording operation to start on determining that the period of time elapsed has reached the period of time necessary for the heat roller to reach the temperature at which a recording operation can be executed, and determined by the instantaneous temperature of the heat roller.

Also, in accordance with the present invention, in a thermal fixing device of the type described, a temperature sensor senses the temperature of the heat roller. A memory stores a table listing a relation between the temperature of the heat roller after the power supply condition has been switched to the record mode and the period of time necessary for the heat roller to reach a temperature at which a recording operation can be executed. A first counter counts a period of time elapsed after the power supply condition has been switched to the record mode. A recording operation starting section causes a recording operation to start on determining that the period of time elapsed has reached the period of time necessary for the heat roller to reach the temperature at which a recording operation can be executed, and determined by the instantaneous temperature of the heat roller. A second timer counts an expected period of time necessary for the paper started to be fed to reach the fixing device. The toner image is fixed on the paper on the elapse of the expected period of time counted by the second timer.

Further, in accordance with the present invention, in a thermal fixing device of the type described, a temperature sensor senses the temperature of the heat roller. An ambient temperature sensor senses an ambient temperature after the power supply condition has been switched to the record mode. A memory stores a table listing a relation between the temperature of the heat roller after the power supply condition has been switched to the record mode and the period of time necessary for the heat roller to reach a temperature at which a recording operation can be executed. A correcting section corrects period of time read out of the table on the basis of the ambient temperature. A first timer counts a period of time elapsed after the power supply condition has been switched to the record mode. A recording operation starting section causes a recording operation to start on determining that the period of time elapsed has reached the period of time corrected by the correcting section.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

Figure 1:
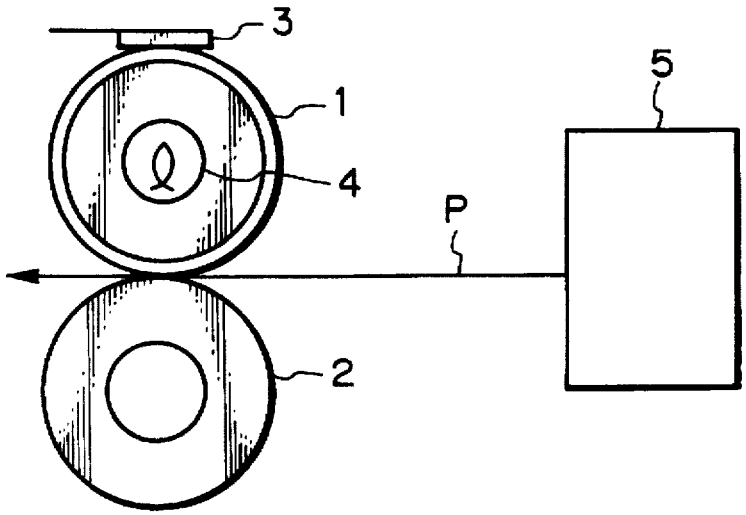
Fig. 1 PRIOR ART
FIG. 1 shows an essential part of a conventional thermal fixing device.

To better understand the present invention, a brief reference will be made to a conventional thermal fixing device, shown in FIG. 1. As shown, the device has a heat roller 1, a press roller 2, and a thermistor 3. A halogen lamp heater or similar heating means 4 is disposed in the heat roller 1. The thermistor 3 is held in contact with the outer periphery of the heat roller 1. The press roller 2 covered with, e.g., a silicone rubber is pressed against the heat roller 1. A paper P carrying a toner image thereon and coming out of an image transfer device 5 is brought into a nip between the heat roller 1 and the press roller 2. As a result, the toner image is melded by heat and fixed on the paper P. The prerequisite is that the heat roller 1 be heated to a fixing temperature at a sufficiently early stage for fixation. However, constantly heating the heat roller 1 by applying a voltage to the heater 4 wastes energy.

To save energy, it has been customary to reduce or stop the supply of power to the heater 4 in a stand-by mode, as distinguished from a record mode. This, however, increases the interval between the time when the stand-by mode is replaced with the record mode and the time when a recording operation can be actually started, i.e., the waiting time. This problem may be solved if the wall thickness of the heat roller 1 and, therefore, the heat capacity is reduced in order to enhance the temperature elevation efficiency. However, the decrease in the wall thickness of the heat roller 1 brings about other problems, as follows.

Figure 2:
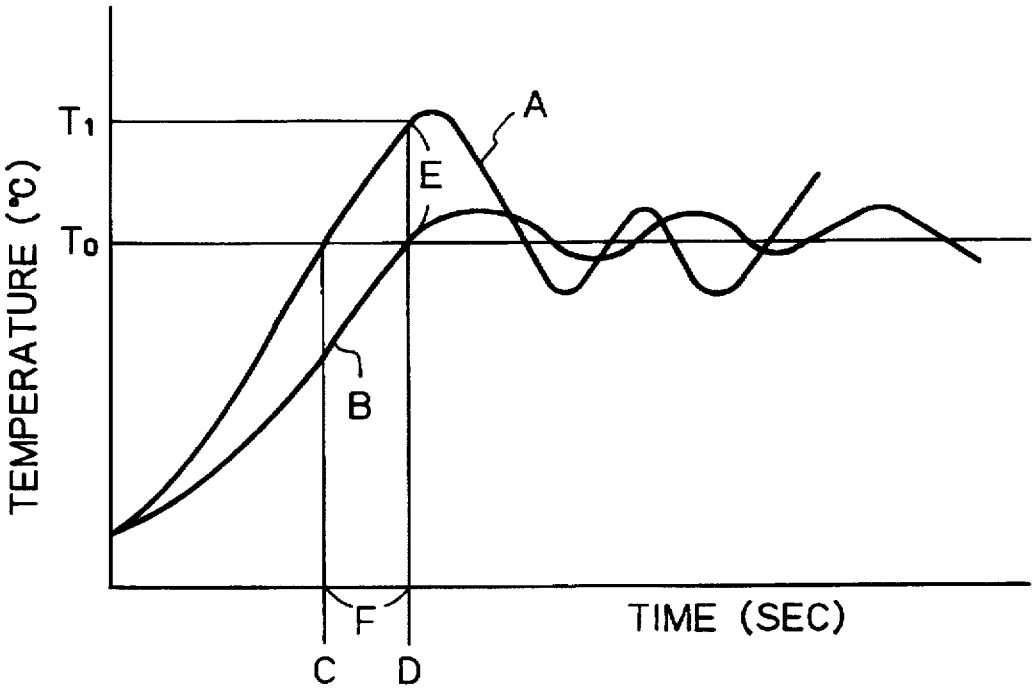
Fig. 2 PRIOR ART
FIG. 2 shows curves respectively representative the surface temperature of a heat roller included in the conventional fixing device and the temperature sensed by a thermistor.

As shown in FIG. 2, the surface temperature of the heat roller 1 rises as represented by a curve A while the temperature sensed by the thermistor 3 varies as represented by a curve B. Despite that the surface temperature A reaches a fixable temperature T0 at a time C, the sensed temperature B is still lower than the temperature T0. As a result, when the sensed temperature B reaches the temperature T0 at a time D, the actual surface temperature A has been elevated to a temperature T1 higher than the temperature T0. Therefore, heat and time are wasted over ranges E and F, respectively. Moreover, assume that the power supply to the heat roller 1 is stopped due to the elevation of the sensed temperature B to the fixable temperature T0, as determined at the time D. Then, the actual surface temperature A sharply falls and continuously falls below the fixable temperature T0 earlier than the sensed temperature B. Hence, even if the power supply to the heat roller 1 is resumed on the detection of the fall of the sensed temperature B to below the temperature T0, the surface temperature A is lower than the temperature T0. The toner image fixed in this condition is defective.

A preferred embodiment of the thermal fixing device in accordance with the present invention will be described with reference to the accompanying drawings. In the drawings, the same or similar constituents as or to the constituents shown in FIG. 1 are designated by the same reference numerals.

Figure 3:
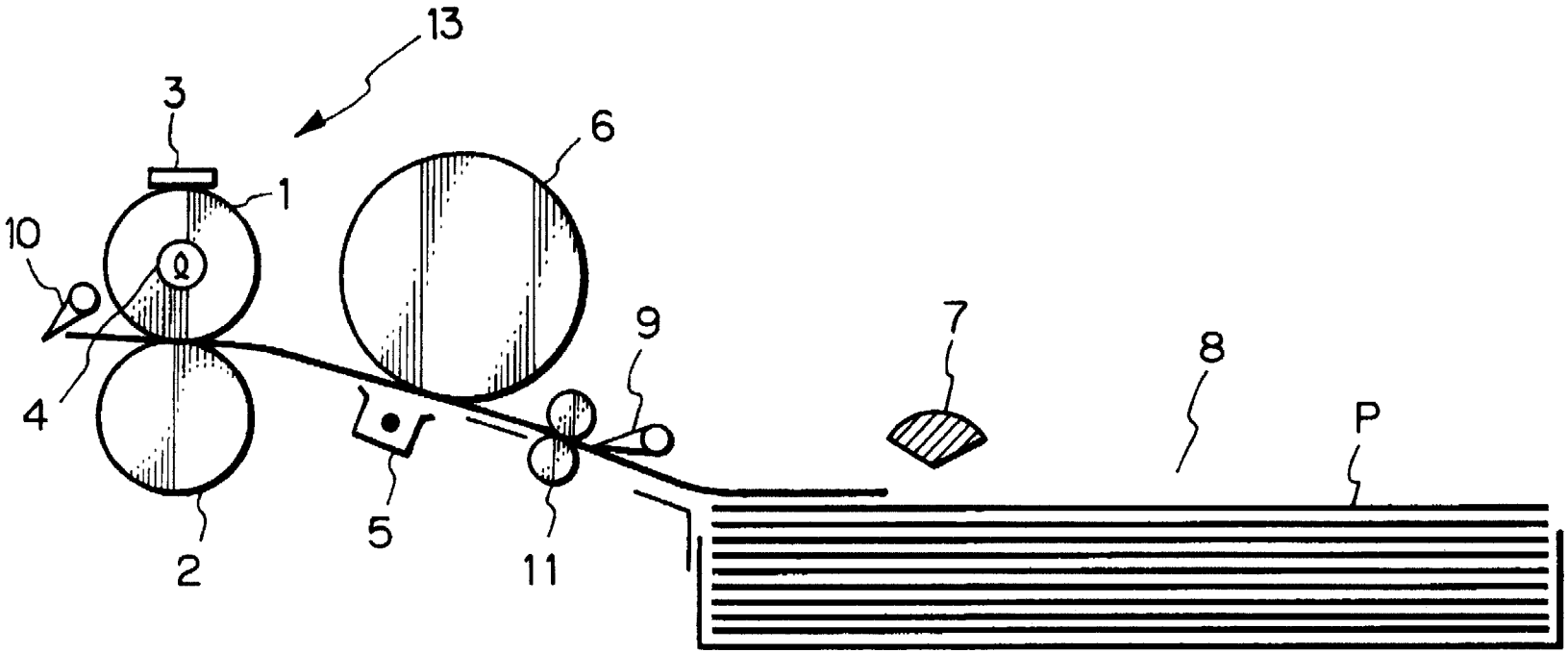
FIG. 3 is a section showing a paper transport path defined in an image forming apparatus to which the present invention is applicable.

FIG. 3 shows a paper transport path defined in an image forming apparatus to which the embodiment is applicable. As shown, a paper P fed from a paper feed section 8 by a pick-up roller 7 is conveyed to an image transfer device 5 by way of a registration sensor 9 and a registration roller pair 11. A toner image is transferred from a photoconductive drum 6 to the paper P by the image transfer device 5. The paper P carrying the toner image thereon is brought to a fixing device 13 having a heat roller 1 and a press roller 2. The heat roller 1 and press roller 2 heat the toner image and thereby fix it on the paper P while conveying it. When the image forming apparatus is switched from its stand-by mode to its record mode, the heat roller 1 starts to be heated. When the heat roller 1 is heated to a recordable temperature high enough for a recording operation to be effected, the drum 6, heat roller 1, registration roller pair 11 and pick-up roller 7 begin to be driven. The reference numeral 10 designates a paper discharge sensor.

Figure 4:
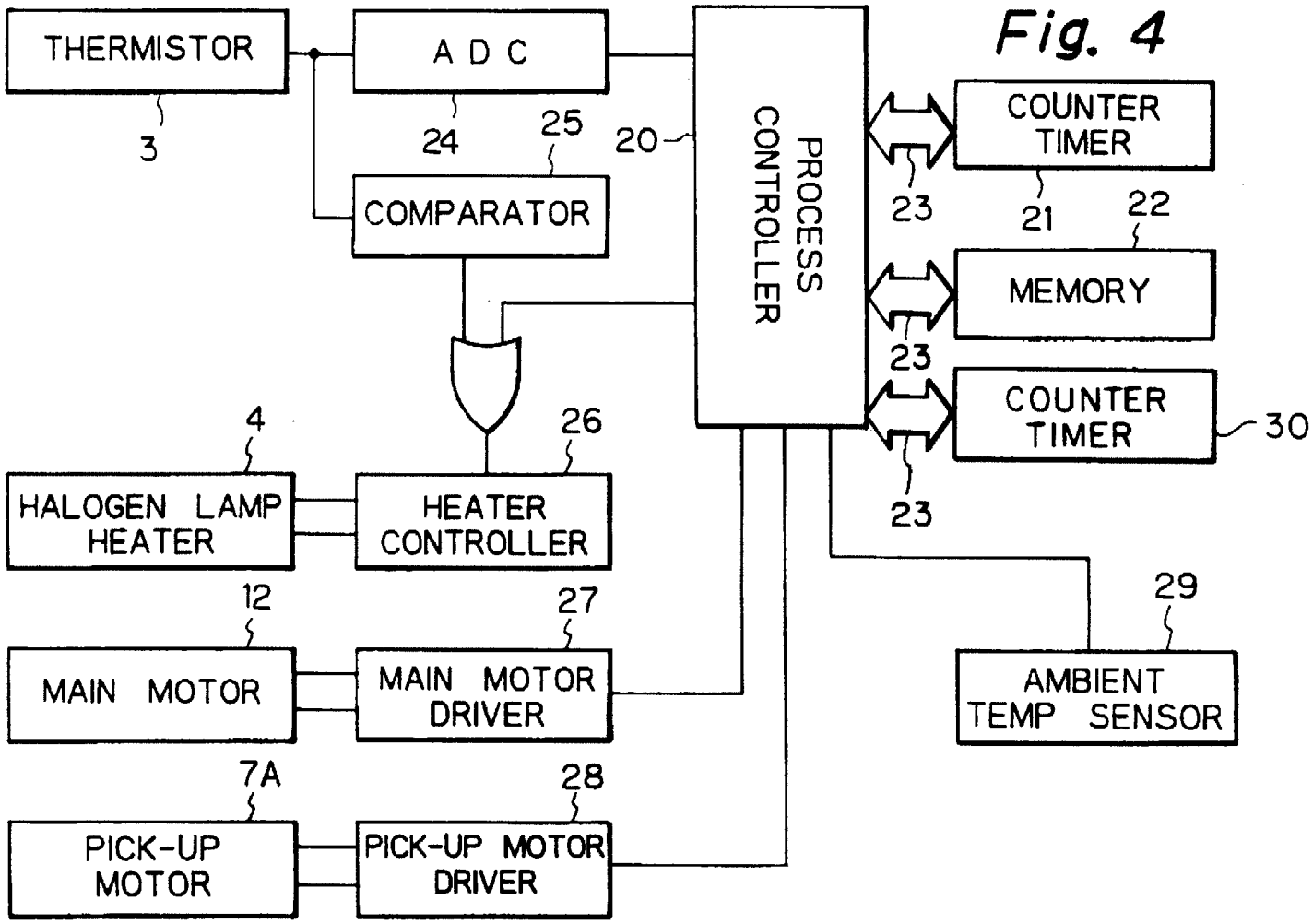
FIG. 4 is a block diagram schematically showing electric circuitry included in a thermal fixing device embodying the present invention.

FIG. 4 shows electric circuitry included in the fixing device 13 embodying the present invention. As shown, an ambient temperature sensor 29 senses temperature around the apparatus or temperature in the vicinity of the paper feed section 8. An analog-to-digital converter (ADC) 24 transforms an analog signal output from the thermistor 3 to a digital signal. A comparator 25 compares temperature represented by the output signal of the thermistor 3 with a preselected elevation limit temperature, and delivers the result of comparison to a heater controller 26. In response, the heater controller 26 controls the power supply to a halogen lamp or heater 4. A main motor driver 27 controls the rotation of a main motor 12. A pick-up motor driver 28 controls the drive of a pick-up motor 7A for feeding the papers P. A counter timer 21 is used to monitor the duration of power supply to the heater 4 and the interval between the start of feed of the paper P and the arrival of the paper P at the fixing device 13. A memory 22 stores a table listing preselected durations of power supply to the heater 4. Specifically, the table stores data representative of a relation between the temperature of the heat roller 1 at the start of heating and the period of time necessary for the roller temperature to reach the fixable temperature (see FIG. 7), and data representative of an expected interval between the start of feed of the paper P and the arrival of the paper P at the fixing device 13. In addition, the memory 22 stores a table listing correction lines associated with the ambient temperature (typically M and M' shown in FIG. 7). A process controller 20 is implemented as a microcomputer for controlling the above various sections. A bus 23 is a signal line over which the process controller 20 interchanges control signals and data with the counter timers 21, 30 and memory 22.

Figure 5:
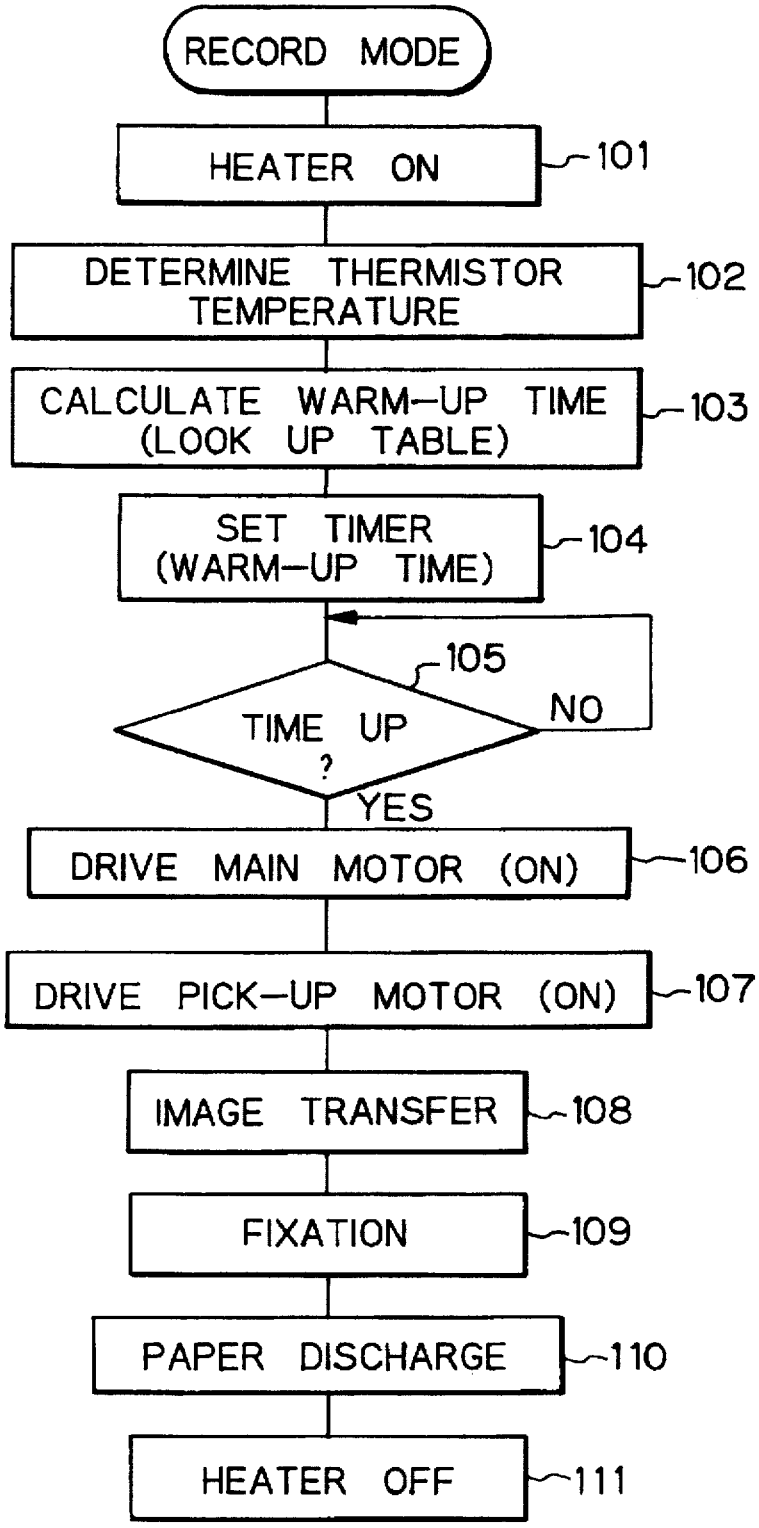
FIG. 5 is a flowchart demonstrating a specific operation of the embodiment.

The operation of the embodiment will be described with reference to FIG. 5. As shown, when the stand-by mode is replaced with the record mode, the heater 4 is turned on in order to start heating the heat roller 1 (step 101). Then, the temperature of the thermistor 3 is sensed (step 2). The table stored in the memory 22 is looked up to read the interval matching the sensed thermistor temperature and necessary for the heat roller 1 to reach the previously mentioned recordable temperature (step 103). The above interval is set in the counter timer 21 (step 104). Subsequently, whether or not the interval set in the counter timer 21 has expired is determined (step 105). If the interval has expired (YES, step 105), the main motor driver 27 starts driving the main motor 12 which, in turn, starts driving the drum 6, registration roller pair 11, and heat roller 1 (step 106). At the same time, the pick-up driver 28 starts driving the pick-up motor 7A, i.e., the pick-up roller 7 (step 107). As a result, the pick-up roller 7 starts feeding the paper P. If the answer of the step 105 is negative (NO), the time is again monitored.

When the paper P arrives at the image transfer device 5 on the elapse of the expected period of time, a toner image is transferred from the drum 6 to the paper P (step 108). As the paper P is brought to the fixing device 18 on the elapse of the expected period of time, the toner image is fixed on the paper P (step 109). Specifically, an arrangement is made such that the expected interval between the start of feed of the paper P and the arrival of the paper P at the fixing device 13 is read out of the memory 22 and set in the counter timer 21, and the heat roller 1 reaches the fixable temperature before the above interval expires. The paper P with the fixed toner image is sensed by the paper discharge sensor 10 (step 110). Then, the heater 4 of the heat roller 1 is turned off (step 111).

As stated above, the embodiment tabulates the periods of time necessary for the heat roller 1 to reach the recordable or record start temperature, and each matching a particular instantaneous temperature of the roller 1. This allows the warm-up time to be accurately set and, in addition, to be controlled. Further, even the period of time in which the paper P is conveyed to the fixing device 13 is available for the heat roller 1 to be heated to the fixable temperature, so that the apparatus can be started to operate in a short period of time.

Figure 6:
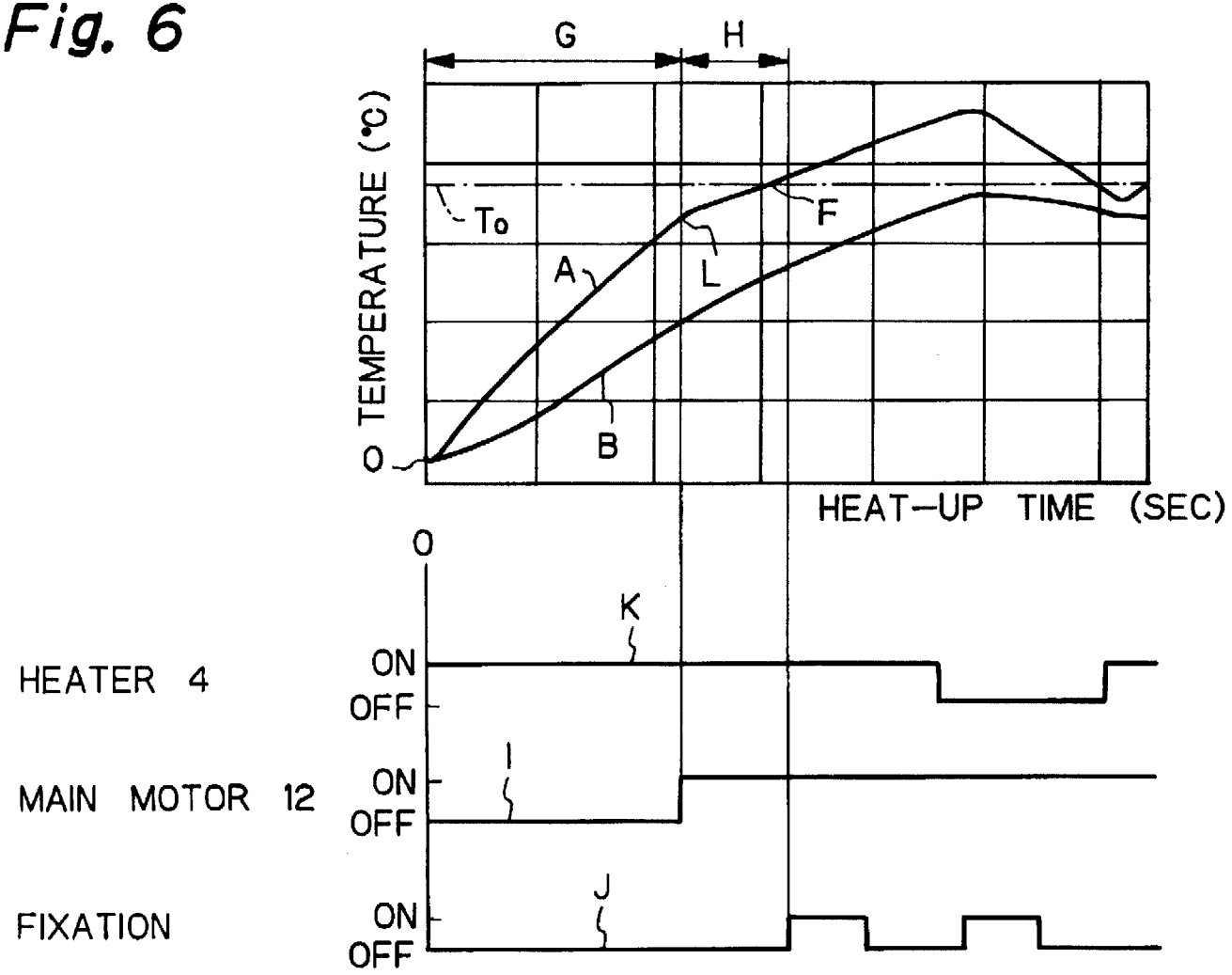
FIG. 6 shows curves respectively representative of the surface temperature of a heat roller included in the embodiment and the temperature sensed by a thermistor.

FIG. 6 shows the variation of the temperature of the heat roller 1; the ordinate and abscissa indicate temperature and time, respectively. The heat roller 1 starts to be heated at a point O. At this time, the surface temperature of the roller 1 and the temperature sensed by the thermistor 3 are equal to each other. A curve A is representative of the surface temperature of the roller 1 actually measured with a thermocouple, while a curve B is representative of the temperature sensed by the thermistor 3. The difference between the curves A and B is ascribable to thermal response delay particular to the thermistor 3. The surface of the roller 1 reaches the fixing temperature T0 at a point F. The recording operation begins at a point L preceding the point F. A period of time H is expected to be necessary between the start of the recording operation and the elevation of the surface temperature of the roller 1 to the temperature T0, i.e., between the start of feed of the paper P and the arrival of the paper P at the fixing device 13. This period of time is determined by structural conditions and remains the same if the structure is not changed. Because the temperature of the roller 1 is elevated at substantially the same rate during the above period of time, the lowest temperature which allows the recording operation to be started is substantially unconditionally determined relative to the fixing temperature T0. A period of time G is necessary for the surface of the roller 1 to be heated from the instantaneous temperature to the temperature at the point L, and this period of time G depends on the surface temperature of the roller 1 at the start of heating. Specifically, if the surface temperature at the start of heating is high, the period of time G is short. The relation between the temperature of the roller 1 at the start of heating and the time necessary for the roller 1 to reach the temperature at the preselected point L is tabulated (see FIG. 7). With this table, it is possible to accurately control the warm-up time up to the time when the fixing device reaches the fixable temperature.

In FIG. 6, a waveform 1 is representative of the operation of the main motor 12. As shown, the motor 12 starts to be driven at the point L. A waveform J is representative of the fixation of the toner image on the paper P; fixation occurs after the point F. The heater 4 is selectively turned on and turned off, as represented by a waveform K.

Figure 7:
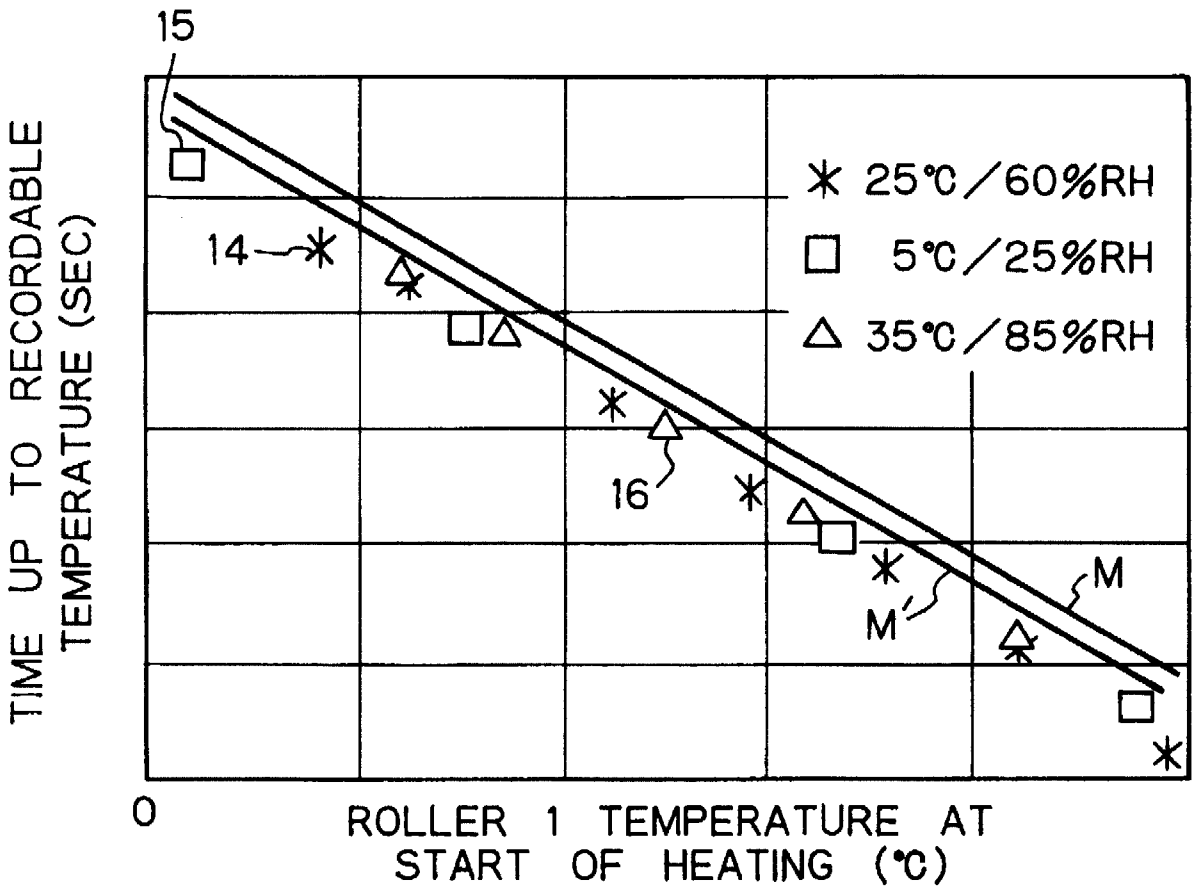
FIG. 7 shows how the temperature of the heat roller varies in accordance with the ambient temperature.

FIG. 7 shows periods of time necessary for the roller 1 to reach the record start temperature and determined on the basis of a relation between the temperature of the roller 1 at the start of heating (elevation) and the ambient temperature. In FIG. 7, the ordinate and abscissa respectively indicate the period of time and the temperature of the roller 1 at the start of heating. Points 14, 15 and 16 are respectively representative of temperatures in a condition wherein ambient temperature is 25° C. and humidity is 60%, a condition wherein ambient temperature is 50° C. and humidity is 25%, and a condition wherein ambient temperature is 35° C. and humidity is 85%. The data plotted on an ambient temperature basis indicate that the period of time for the record start time preselected for every heat start temperature is proportional without regard to the ambient temperature. It follows that if the instantaneous temperature of the roller 1 at the start of heating is known, the period of time up to the time when it reaches the previously stated record start temperature can be accurately determined.

It is to be noted that the ambient temperature may the temperature around the fixing device 13 or the temperature inside or outside of the apparatus.

In FIGS. 7, curves M and M' are each is representative of the periods of time up to the time when the record start temperature is reached, and corrected by the ambient temperature. Specifically, the curve M shows the periods of time corresponding to the ambient temperature of 10° C. As the ambient temperature rises, the curve M approaches the curve M' or the previously mentioned plotted data in FIG. 7, and the correction value decreases. This is because the heat of the roller 1 is lost in an amount corresponding to the ambient temperature, i.e., the temperature of the paper P; heat is added in order to make up for the loss. For this purpose, when the ambient temperature is 10° C., the period of time up to the time when the record start time is reached is increased by about 0.8 second. the data shown in FIG. 7 are stored in the form of a table in the memory 22.

In summary, a thermal fixing device of the present invention has various unprecedented advantages as enumerated below.

(1) When a heat roller starts to be heated, a warm-up time matching the instantaneous roller temperature can be set and controlled with accuracy. This successfully prevents the warm-up time from increasing and thereby reduces the waiting time up to the time at which a recording operation can be started.

(2) The interval between the start of a paper after the start of a recording operation and the arrival of the paper at the fixing device is available for the elevation of the roller temperature to a fixable temperature. This also prevents the above warm-up time from increasing and thereby reduces the waiting time.

(3) A period of time necessary for the roller temperature to reach a temperature at which the recording operation can be started is corrected on the basis of the instantaneous ambient temperature. Therefore, it is possible to set a warm-up time insuring high fixing quality even when the temperature of the paper varies, particularly when the paper temperature is low. In addition, the warm-up time and waiting time are reduced.

Various modifications will become possible for those skilled in the art after receiving the teachings of the present disclosure without departing from the scope thereof.

What is claimed is:

1. A thermal fixing device having a standby mode during idle periods, and a record mode for fixing a toner image on a paper by heating a heat roller by setting up a particular power supply condition to said heat roller, said device comprising:

temperature sensing means for sensing a temperature of said heat roller;

storing means storing a table listing a relation between a temperature of said heat roller after the power supply condition has been switched to the record mode and a period of time necessary for said heat roller to reach a temperature at which a recording operation can be executed;

time counting means for counting a period of time elapsed after the power supply condition has been switched to the record mode; and recording operation starting means for causing a recording operation to start on determining that the period of time elapsed has reached the period of time necessary for said heat roller to reach the temperature at which a recording operation can be executed, and determined by an instantaneous temperature of said heat roller;

whereby an exact period of time for the heat roller to reach an operational temperature is determined for a wide range of initial heat roller temperatures.

2. A thermal fixing device having a standby mode during idle periods, and a record mode for fixing a toner image on a paper by heating a heat roller by setting up a particular power supply condition to said heat roller, said device comprising:

temperature sensing means for sensing a temperature of said heat roller;

storing means storing a table listing a relation between a temperature of said heat roller after the power supply condition has been switched to the record mode and a period of time necessary for said heat roller to reach a temperature at which a recording operation can be executed;

first time counting means for counting a period of time elapsed after the power supply condition has been switched to the record mode;

recording operation starting means for causing a recording operation to start on determining that the period of time elapsed has reached the period of time necessary for said heat roller to reach the temperature at which a recording operation can be executed, and determined by an instantaneous temperature of said heat roller; and second time counting means for counting an expected period of time necessary for the paper started to be fed to reach said fixing device;

wherein the toner image is fixed on the paper on elapse of the expected period of time counted by said second time counting means; and whereby an exact period of time for the heat roller to reach an operational temperature is determined for a wide range of initial heat roller temperatures.

3. A thermal fixing device for fixing a toner image on a paper by heating a heat roller while setting up a particular power supply condition to said heat roller for each of a stand-by mode and a record mode, said device comprising:

temperature sensing means for sensing a temperature of said heat roller;

ambient temperature sensing means for sensing an ambient temperature after the power supply condition has been switched to the record mode;

storing means storing a table listing a relation between a temperature of said heat roller after the power supply condition has been switched to the record mode and a period of time necessary for said heat roller to reach a temperature at which a recording operation can be executed;

correcting means for correcting the period of time read out of said table on the basis of the ambient temperature;

first time counting means for counting a period of time elapsed after the power supply condition has been switched to the record mode; and recording operation starting means for causing a recording operation to start on determining that the period of time elapsed has reached the period of time corrected by said correcting means.

* * * * *